US006756953B1

(12) United States Patent
Tokioka et al.

(10) Patent No.: US 6,756,953 B1
(45) Date of Patent: Jun. 29, 2004

(54) LIQUID CRYSTAL DISPLAY DEVICE IMPLEMENTING GRAY SCALE BASED ON DIGITAL DATA AS WELL AS PORTABLE TELEPHONE AND PORTABLE DIGITAL ASSISTANCE DEVICE PROVIDED WITH THE SAME

(75) Inventors: Hidetada Tokioka, Tokyo (JP); Masafumi Agari, Tokyo (JP); Hiroyuki Murai, Tokyo (JP); Mitsuo Inoue, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 550 days.

(21) Appl. No.: 09/716,242

(22) Filed: Nov. 21, 2000

(30) Foreign Application Priority Data

Mar. 31, 2000 (JP) ..... 2000-098110 (P)

(51) Int. Cl.[7] ..... G09G 3/36

(52) U.S. Cl. ..... 345/87; 345/90; 345/93; 345/204

(58) Field of Search ..... 345/87, 90, 92, 345/96, 98, 100, 93, 204, 690; 349/151; 359/55, 57, 58–88

(56) References Cited

U.S. PATENT DOCUMENTS 5,162,931 A * 11/1992 Holmberg ..... 349/54
5,164,851 A * 11/1992 Kanemori et al. ..... 349/55
5,319,480 A * 6/1994 McCartney ..... 349/85
5,436,747 A * 7/1995 Suzuki ..... 349/42
5,646,702 A * 7/1997 Akinwande et al. ..... 349/69
5,977,940 A 11/1999 Akiyama et al.
6,335,778 B1 * 1/2002 Kubota et al. ..... 349/151

FOREIGN PATENT DOCUMENTS

| | | |
|---|---|---|
| EP | 597 536 A2 | 5/1994 |
| EP | 1 026 658 A1 | 8/2000 |
| JP | 58-196582 | 11/1983 |
| JP | 3-53128 | 3/1991 |
| JP | 5-30166 | 2/1993 |
| JP | 8-194295 | 7/1996 |
| JP | 9-113933 | 5/1997 |
| WO | WO 00/08626 | 2/2000 |

OTHER PUBLICATIONS

U.S. patent application Ser. No. 09/708,599, Inoue et al., filed Nov. 9, 2000.

* cited by examiner

*Primary Examiner*—Regina Liang
*Assistant Examiner*—Jennifer T. Nguyen
(74) *Attorney, Agent, or Firm*—Leydig, Voit & Mayer, Ltd.

(57) ABSTRACT

Each of pixels arranged in a matrix is divided into sub pixels. Horizontal scanning lines and vertical scanning lines are arranged corresponding to rows and columns of the sub pixels, so that each sub pixel can be independently on and off. Each pixel includes a sub pixel connection circuit arranged between the sub pixels. A sub pixel connection circuit connects the pixel electrodes of corresponding sub pixels in accordance with a sub pixel connection signal input from a data line in synchronization with activation of vertical scanning line.

13 Claims, 6 Drawing Sheets

LIQUID CRYSTAL DISPLAY DEVICE IMPLEMENTING GRAY SCALE BASED ON DIGITAL DATA AS WELL AS PORTABLE TELEPHONE AND PORTABLE DIGITAL ASSISTANCE DEVICE PROVIDED WITH THE SAME

BACKGROUND OF THE INVENTION

1. Field of the Invention

The present invention relates to liquid crystal display devices for displaying an image using a liquid crystal and, more specifically, to a liquid crystal display device implementing a gray scale.

2. Description of the Background Art

Recently, liquid crystal display devices have been used as display panels for personal computers television receivers, portable telephones and the like. The liquid crystal display device has an advantage over a conventional display device because of its low power consumption and compactness.

FIG. 8 is a block diagram showing an overall structure of a conventional liquid crystal display device 500.

Referring to FIG. 8, liquid crystal display device 500 is provided with a liquid crystal display portion 1002 including a plurality of pixels 1001 arranged in a matrix. In a color liquid crystal display device, one pixel 1001 consists of pixels 1005 of R (Red), G (Green) and B (Blue). It is noted that, in the following description, the pixel corresponding to the above mentioned reference numeral 1005 is referred to as "pixel."

Pixels 1005 are arranged in a matrix in liquid crystal display portion 1002. Liquid crystal display device 500 further includes vertical scanning lines 1010 and common lines 1012 arranged corresponding to rows of pixels and horizontal scanning lines 1011 arranged corresponding to columns of pixels.

FIG. 9 is a circuit diagram showing a structure of pixel 1005.

Referring to FIG. 9, pixel 1005 includes a liquid crystal display element 1102 having a pixel electrode and a common electrode arranged opposite to each other. Nodes respectively connected to the pixel electrode and common electrode of the liquid crystal display element are hereinafter referred to as a pixel electrode node Na and a common electrode node Nb.

The orientation of liquid crystal molecules in the liquid crystal display element changes in accordance with the potential difference between pixel electrode node Na and common electrode node Nb. The luminance of the liquid crystal display element thereby changes, enabling the luminance of each pixel to be controlled.

Pixel 1005 further includes: a storage capacitor 1103 arranged between pixel electrode node Na and common line 1012; and a TFT (Thin Film Transistor) element 1101 having its gate connected to vertical scanning line 1011 and electrically connected between signal line 1011 and pixel electrode node Na.

In pixel 1005, a positive voltage is applied to vertical scanning line 1010 (activation), so that TFT element 1101 is turned on and the potential level of horizontal scanning line 1011 is transmitted to pixel electrode node Na. Liquid crystal display element 1102 per se has a capacitance, and therefore liquid crystal display element 1102 and storage capacitor 1103 are charged with electricity by turning on TFT element 1101.

If vertical scanning line 1010 is inactivated and TFT element 1001 is turned off, on the other hand, the potential level of pixel electrode node Na is retained by storage capacitor 1103.

Returning to FIG. 8, liquid crystal display device 500 further includes a vertical scanning circuit 1003 for sequentially selecting the rows of pixels with a prescribed period, and a horizontal scanning circuit 1006 for supplying a display signal, which is a voltage signal corresponding to display data, to each column of pixels.

Vertical scanning circuit 1003 includes a shift register circuit 1004 and a buffer circuit 1005, and sequentially activates vertical scanning lines 1010 and applies a positive voltage thereto for sequentially selecting the rows of pixels with a prescribed period.

Horizontal scanning circuit 1006 includes a shift register circuit 1007 and a buffer circuit 1008 for sequentially selecting the columns of pixels with a prescribed period, as well as a switch 1009 arranged between display signal line 1013 and horizontal scanning line 1011. Switch 1009 is arranged corresponding to each row of pixels for connecting/disconnecting corresponding display signal line 1013 and horizontal scanning line 1011. Switches 1009 are sequentially turned on in accordance with a signal with a prescribed period. Display signal lines 1013 are respectively arranged for three pixels of R, G and B since liquid crystal display device 500 is a color display device.

Once display signals are written to pixels in one row of pixels by horizontal scanning circuit 1006, i.e., one row of pixels is scanned, vertical scanning circuit 1003 inactivates vertical scanning line 1010 that has been selected so far and applies a 0 or negative voltage thereto for selecting a next row of pixels, and activates the following vertical scanning line 1010 and applies a positive voltage thereto.

The next row of pixels is similarly scanned. When vertical scanning circuit 1003 scans all rows of pixels (this is also referred to as 1 frame), the leading vertical scanning line 1012 is again activated and a positive voltage is applied thereto. Thus, an image is displayed by sequentially writing display signals to all pixels in one frame.

As described above, in conventional liquid crystal display device 500, the luminance of each pixel corresponds to the potential level of pixel electrode node Na. Thus, an analog signal having a potential level corresponding to a gradation tone must be written from a horizontal scanning line to pixel electrode node Na to implement a gray scale of the pixels. Accordingly, digital/analog conversion is required if display data which is externally input to the liquid crystal display device is digital data.

A so-called area ratio gray scale method of dividing each pixel into a plurality of portions is known to provide a structure of implementing the gray scale in accordance with a display signal, which is a digital signal.

FIG. 10 is a diagram used for explaining the concept of the area ratio gray scale method.

Referring to FIG. 10, pixel 1005 is divided into a plurality of sub pixels SPX1 to SPXn (n: natural number) in the area ratio gray scale method. Each of sub pixels SPX1 to SPXn is independently turned on (maximum luminance) and off (minimum luminance) in accordance with a digital signal. Accordingly, if a sub pixel to be turned on is selected in accordance with the display signal of digital data in each pixel 1005, a gray scale is achieved in proportion to the area of the selected sub pixel.

However, the area ratio gray scale method suffers from a problem that the pixel must be divided into a larger number of sub pixels to increase the number of gradations. The increase in the number of sub pixels results in an increase in the size of each pixel whereby display resolution and quality are disadvantageously reduced.

SUMMARY OF THE INVENTION

An object of the present invention is to provide a liquid crystal display device capable of implementing a multiple-gray scale using digital data without impairing a display quality such as resolution.

Another object of the present invention is to provide a portable telephone and portable information assistance device provided with a liquid crystal display portion capable of implementing a multiple-gray scale by digital data without impairing display quality and continuously displaying the same image with low power consumption.

In short, the present invention is a liquid crystal display device including a plurality of vertical and horizontal scanning lines and a plurality of pixels.

The plurality of vertical and horizontal scanning lines are arranged in a matrix. The plurality of pixels are also arranged in a matrix. Each of the plurality of pixels includes M (M: natural number of at least 2) sub pixels. Each sub pixel corresponds to one of the plurality of vertical scanning lines and one of the plurality of horizontal scanning lines. Each sub pixel includes a liquid crystal display element as well as a common electrode and a pixel electrode arranged on either side of the liquid crystal display element. Each pixel further includes a sub pixel connection switch arranged between pixel electrodes of two of the M sub pixels. The sub pixel connection switch corresponds to one of the plurality of vertical scanning lines and one of the plurality of horizontal scanning lines and is turned on/off in accordance with the potential level of the corresponding vertical and horizontal scanning lines.

According to another aspect, the present invention is a portable telephone provided with a liquid crystal display portion. The liquid crystal display portion displays information in accordance with a digital signal.

The liquid crystal display portion includes: a plurality of vertical and horizontal scanning lines arranged in a matrix; a plurality of sub vertical scanning lines, a plurality of first reference potential lines, and a plurality of second reference potential lines, respectively arranged corresponding to the plurality of vertical scanning lines; and a plurality of pixels arranged in a matrix. Each pixel has M (M: natural number of at least 2) sub pixels. Each sub pixel corresponds to one of the plurality of vertical scanning lines and one of the plurality of horizontal scanning lines. Each sub pixel includes: a liquid crystal display element; a common electrode and a pixel electrode arranged on either side of the liquid crystal display element; a first switch element connecting the corresponding horizontal scanning line and a first internal node in accordance with the potential of the corresponding vertical scanning line; a capacitor for control for retaining the potential level of the first internal node; a connection switching circuit connecting one of the first and second reference potential lines to a second internal node in accordance with the potential level of the first internal node; and a second switch element connecting the second internal node to the pixel electrode in accordance with the potential of the corresponding sub vertical scanning line. Each pixel further includes a sub pixel connection switch arranged between the pixel electrodes of two of the M sub pixels. The sub pixel connection switch corresponds to one of the plurality of vertical scanning lines and one of the plurality of horizontal scanning lines and is turned on/off in accordance with the potential levels of the corresponding vertical and horizontal scanning lines.

According to another aspect, the present invention is a portable digital assistance device provided with a liquid crystal display portion. The liquid crystal display portion includes: a plurality of vertical and horizontal scanning lines arranged in a matrix; a plurality of sub vertical scanning lines, a plurality of first reference potential lines, and a plurality of second reference potential lines, respectively arranged corresponding to the plurality of vertical scanning lines; and a plurality of pixels arranged in a matrix. Each pixel has M (M: natural number of at least 2) sub pixels. Each sub pixel corresponds to one of the plurality of vertical scanning lines and one of the plurality of horizontal scanning lines. Each sub pixel includes: a liquid crystal display element; a common electrode and a pixel electrode arranged on either side of the liquid crystal display element; a first switch element connecting the corresponding horizontal scanning line and a first internal node in accordance with the potential of the corresponding vertical scanning line; a capacitor for control for retaining the potential level of the first internal node; a connection switching circuit connecting one of the first and second reference potential lines to a second internal node in accordance with the potential level of the first internal node; and a second switch element connecting the second internal node to the pixel electrode in accordance with the potential of the corresponding sub vertical scanning line. Each pixel further includes a sub pixel connection switch arranged between the pixel electrodes of two of the M sub pixels. The sub pixel connection switch corresponds to one of the plurality of vertical scanning lines and one of the plurality of horizontal scanning lines and the display portion of the corresponding vertical and horizontal portions display information in accordance with a digital signal.

Accordingly, a main advantage of the present invention is that the number of gradation tones can be increased by a switch connecting the pixel electrodes of the sub pixels when a gray scale is to be achieved in each pixel by turning on/off each sub pixel based on digital data.

Further, in the liquid crystal display portion, the number of gradations can be increased in accordance with a digital signal, and one of the first and second reference potential lines can be periodically connected to the pixel electrode of each sub pixel in accordance with the potential level retained at the internal node by the capacitor for control. Thus, when continuously displaying the same image, a writing operation at a high frequency for driving vertical and horizontal scanning lines needs not be performed. As a result, power consumption of the portable telephone and portable digital assistance device can be reduced.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The embodiments of the present invention will now be described in detail with reference to the drawings.

First Embodiment

Figure 1:
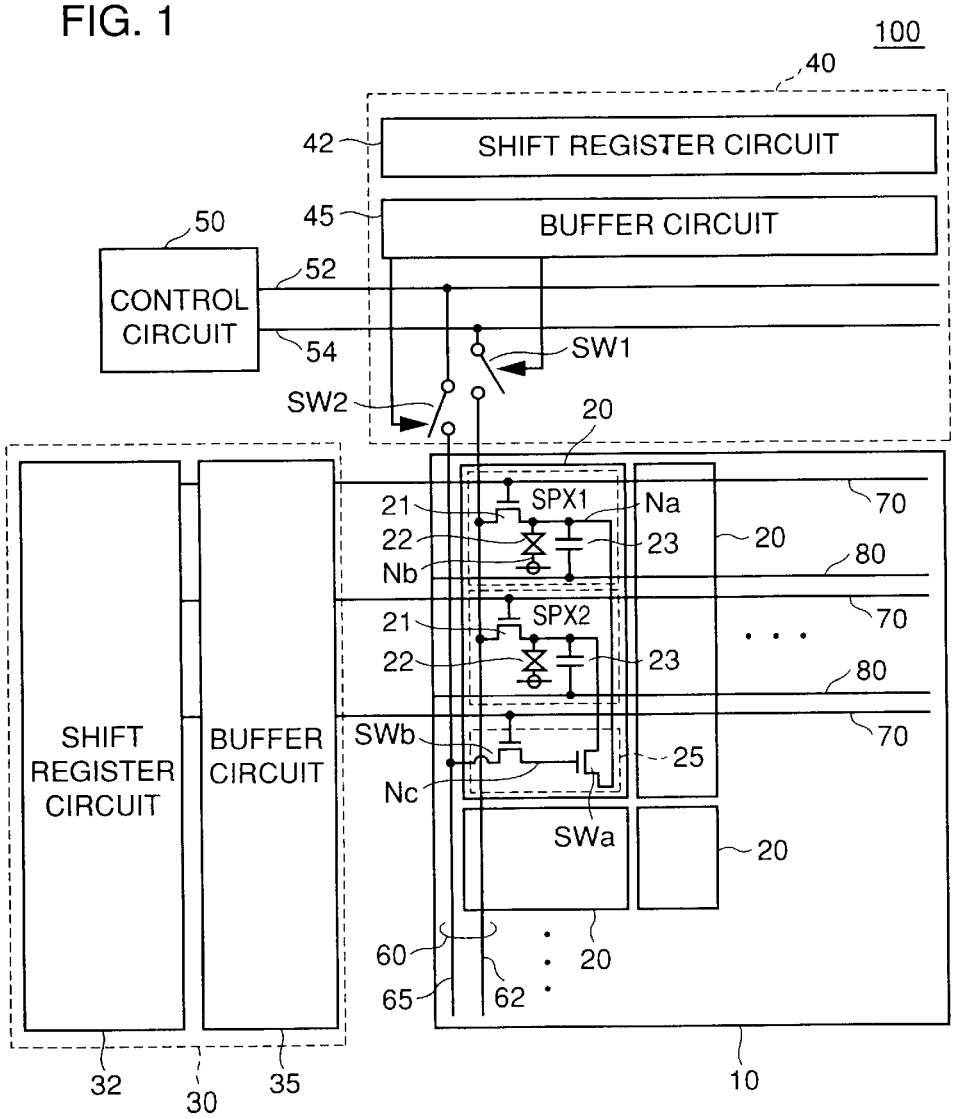
FIG. 1 is a block diagram showing an overall structure of a liquid crystal display device 100 according to the first embodiment of the present invention.

FIG. 1 shows a block diagram showing an overall structure of a liquid crystal display device 100 according to the first embodiment of the present invention.

The liquid crystal display device of the present invention can be applied to any of color and monochromic liquid crystal display devices, and therefore the structure of each pixel (corresponding to pixel 1005 in FIG. 8) will be described in the following.

When liquid crystal display device 100 is used for displaying a color image, a color filter of one of R, G and B is provided for each of pixels having similar structures, and three pixels form one display unit.

Referring to FIG. 1, liquid crystal display device 100 is provided with a liquid crystal display portion 10 including a plurality of pixels 10 arranged in a matrix. Each pixel 20 includes sub pixels SPX1 and SPX2 as well as the sub pixel connection circuit 25. Although not shown in the drawing, each of the other pixels 20 arranged in a matrix is divided into sub pixels SPX1 and SPX2 and provided with sub pixel connection switch circuit 25.

Accordingly, sub pixels SPX1, SPX2 and sub pixel connection circuit 25 are arranged in a matrix over liquid crystal display portion 10. An independent vertical scanning line 70 is arranged corresponding to each row of sub pixels and sub pixel connection circuits. Further, a horizontal scanning line 60 is arranged corresponding to each column of pixels.

In the example shown in FIG. 1, pixel 20 is divided in a horizontal direction, so that horizontal scanning line 60 is shared by sub pixels SPX1, SPX2 and sub pixel connection circuit 25.

Horizontal scanning line 60 includes a first data line 62 transmitting data corresponding to a display signal and a second data line 65 transmitting a sub pixel connection signal for controlling connection between the sub pixels. Further, a common line 80 is arranged corresponding to each column of sub pixels. Common line 80 supplies a corresponding potential to a common electrode node Nb.

Sub pixel SPX1 further includes: a liquid crystal display element 22; a storage capacitor 23 arranged between a pixel electrode node Na and common line 80; and a TFT element 21 having its gate connected to vertical scanning line 70 and electrically connected between first data line 62 and pixel electrode node Na. TFT element 21 is exemplified as the switch element.

Figure 9:
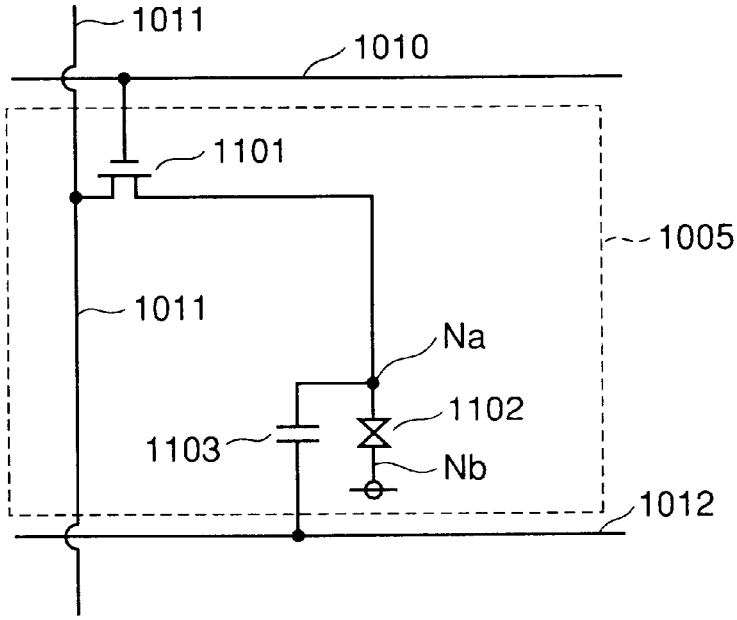
FIG. 9 PRIOR ART
FIG. 9 is a circuit diagram showing the structure of a pixel.
Figure 10:
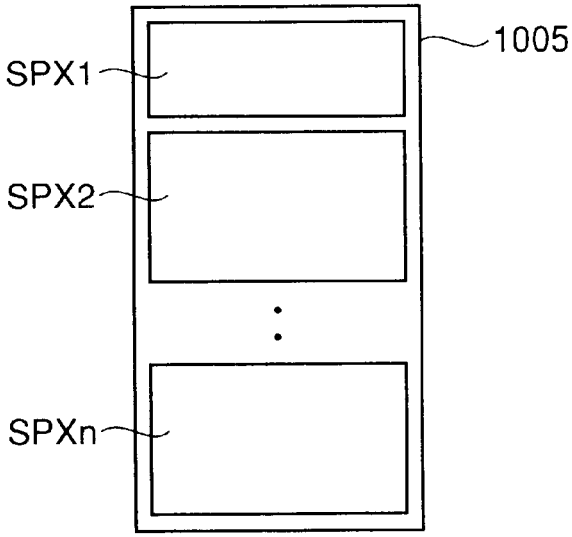
FIG. 10 PRIOR ART
FIG. 10 is a diagram used for explaining a concept of the area ratio gray scale method.

TFT element 21, liquid crystal display element 22 and storage capacitor 23 respectively correspond to TFT element 1101, liquid crystal display element 1102 and storage capacitor 1103 described with reference to FIG. 9. Similarly, vertical scanning line 70, common line 80 and first data line 62 respectively correspond to vertical scanning line 1010, common line 1012 and horizontal scanning line 1011 in FIG. 7. The other sub pixels have a structure similar to that of sub pixel SPX1.

Figure 8:
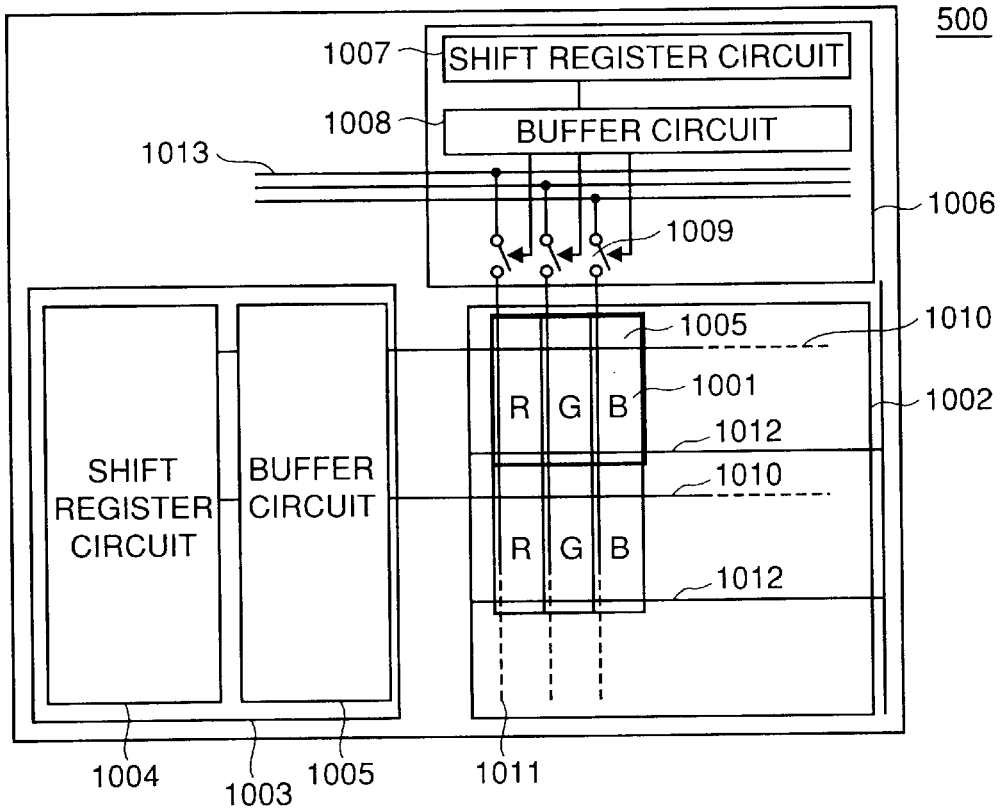
FIG. 8 PRIOR ART
FIG. 8 is a block diagram showing an overall structure of a conventional liquid crystal display device.

Vertical scanning circuit 30 corresponds to vertical scanning circuit 1103 described with reference to FIG. 8 and sequentially activates vertical scanning lines 70 with a prescribed period and applies a positive voltage thereto.

A control circuit 50 outputs a sub pixel connection signal to a sub pixel connection select signal line 52 and outputs a display signal to a display signal line 54. Horizontal scanning circuit 40 includes a shift register circuit 42, a buffer circuit 45, a switch SW1 arranged between display signal line 54 and first data signal 62, and a switch SW2 arranged between sub pixel connection select signal line 52 and a second data line 65.

Switches SW1 and SW2 are arranged for every column of pixels. Switches SW1 and SW2 arranged corresponding to each column of pixels are sequentially turned on by shift register circuit 42 and buffer circuit 45. Horizontal scanning circuit 40 supplies a corresponding display signal and sub pixel connection signal to each column of pixels through first and second data signals 62 and 65.

In the case of a so-called point at a time method, sub pixels in one row are supplied with display signals by horizontal scanning circuit 40 and charged with electricity. When the display signals are supplied to the sub pixels in one row, vertical scanning circuit 30 switches among vertical scanning lines 70 to be activated for selecting next row. Thus, vertical scanning line 70 which has been activated so far is inactivated so that the potential level thereof attains to 0 or a negative voltage. Thus, corresponding TFT element 21 is turned off and the potential level of pixel electrode node Na is retained.

Liquid crystal display device 100 has a circuit structure allowing a display signal to be independently supplied to each sub pixel. Accordingly, each sub pixel can be independently turned on/off, whereby a gray scale can be implemented by each pixel 20 even when the display signal is digital data.

Liquid crystal display device 100 can implement a gray scale with a greater number of tones because of a sub pixel connection circuit 25 arranged between sub pixels SPX1 and SPX2.

Sub pixel connection circuit 25 includes: a sub pixel connection switch SWa connecting the pixel electrode nodes of sub pixels SPX1 and SPX2 in accordance with the potential level of a connection control node Nc; and a connection control switch SWb connecting second data line 65 and connection control node Nc in accordance with the potential level of vertical scanning line 70.

This enables a sub pixel connection signal to be incorporated into connection control node Nc from second data line 65 at a timing designated by activation of vertical scanning line 70 and, accordingly, connection between the sub pixels can be controlled.

Figure 2:
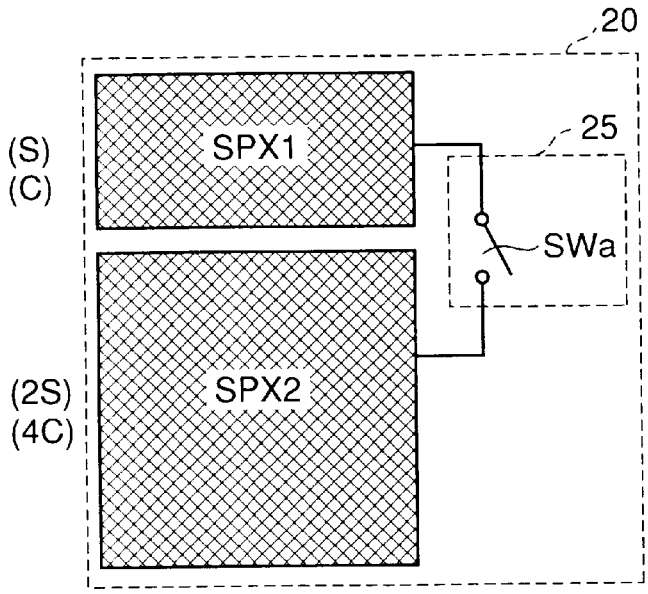
FIG. 2 is a diagram used for explaining a concept of connection between sub pixels in a liquid crystal display device.

FIG. 2 shows a diagram used for explaining a concept of connection between the sub pixels in liquid crystal display device 100.

Referring to FIG. 2, sub pixels SPX1 and SPX2 are different in display area. Here, a display area ratio of sub pixels SPX1 to SPX2 is S:2S in FIG. 2, by way of example. A ratio of capacitance values of the sub pixels is C:4C. Here, the capacitance value of the sub pixels is calculated as a sum of the capacitances of storage capacity 23 and liquid crystal display element 22.

First, if sub pixel is SPX1 is turned on to write a potential V to the pixel electrode node and sub pixel SPX2 is turned off, the potential at the pixel electrode node (hereinafter simply referred to as a pixel electrode potential) of sub pixel SPX is V and the pixel electrode potential of sub pixel SPX2 is 0.

Assume that the luminance of each sub pixel is in proportion to a product of the pixel electrode potential and the display area. Then, the luminance of the pixel before connecting the sub pixels is expressed as follows.

$$V\times S+0\times 2S=V\cdot S$$

Successively, if a positive voltage is applied to the second data line in a period in which a positive voltage is supplied to the vertical scanning line corresponding to connection control switch SWb, sub pixel connection switch SWa is turned on and the pixel electrodes of the sub pixels are connected. Accordingly, electric charges are reallocated to sub pixels SPX1 and SPX2, so that the potentials of the pixel electrodes of the sub pixels change.

Namely, if the pixel electrode potential of the sub pixels after the connection is V', the following equation (1) is obtained.

$$V'\times(C+4C)=V\times C+0\times 4C \quad (1)$$

From equation (1), an equation V'=V/5 is derived. Accordingly, the potential level of the pixel electrode of sub pixel SPX1 changes from V to V/5, whereas the potential level of the pixel electrode of sub pixel SPX2 changes from 0 to V/5.

The luminance after the connection of the sub pixels is expressed by the following equation. Thus, another tone may be derived by connecting the sub pixels.

$$V/5\times S+V/5\times 2S=3/5\cdot V\cdot S$$

Then, assume that on and off states of sub pixels SPX1 and SPX2 are interchanged. More specifically, assume that sub pixel SPX2 is turned on to write a potential V to the pixel electrode node and the pixel electrodes of the sub pixels are connected after turning off sub pixel SPX1.

Similarly, if the luminance of each sub pixel is in proportion to a product of the pixel electrode potential and the display area, the luminance of the pixel before the connection of the sub pixels is as follows.

$$0\times S+V\times 2S=2\cdot V\cdot S$$

Likewise, if pixel electrode potential after the connection is V', the following equation (2) is obtained rather than the above equation (1).

$$V'\times(C+4C)=0\times C+V\times 4C \quad (2)$$

An equation of V'=4/5·V is derived from the equation (2). Thus, the potential level of the pixel electrode of sub pixel SPX1 changes from 0 to 4/5·V, whereas the potential level of the pixel electrode of sub pixel SPX2 changes from V to 4/5·V.

On the other hand, the luminance after the connection of the sub pixels can be expressed by the following equation.

$$4/5\cdot V\times S+4/5\cdot V\times 2S=12/5\cdot V\cdot S$$

As described above, another tone can newly be derived by the connection of the sub pixels.

As in the foregoing, the pixel divided into sub pixel SPX1 (area S, capacitance C) and sub pixel SPX2 (area 2S, capacitance 4C) can implement the gray scale in the following cases.

(1) SPX1 and SPX2 are both turned off (0), (2) Only SPX1 is turned on (S·V), (3) Only SPX2 is turned on (2·S·V), and (4) SPX1 and SPX2 are both turned on (3·S·V). In addition to the above four tones, the above described two types of connections of the sub pixels can implement two intermediate tones in the following cases.

(5) The sub pixels are connected after turning on only sub pixel SPX1 ((3/5)·V·S), and (6) The sub pixels are connected after turning on only sub pixel SPX2 ((12/5) ·VS). Consequently, a greater number of tones can be implemented without increasing the number of sub pixels of each pixel.

As is apparent from the above example, a greater number of intermediate tones can be implemented if the display areas and capacitance values of the sub pixels are different. The number of intermediate tones implemented by the connection of the sub pixels can be adjusted by the area ratio and capacitance ratio of the sub pixels.

In the above description, each pixel is divided into two sub pixels in liquid crystal display device 100. However, each pixel may be divided into a plurality of, for example, at least three sub pixels.

Figure 3:
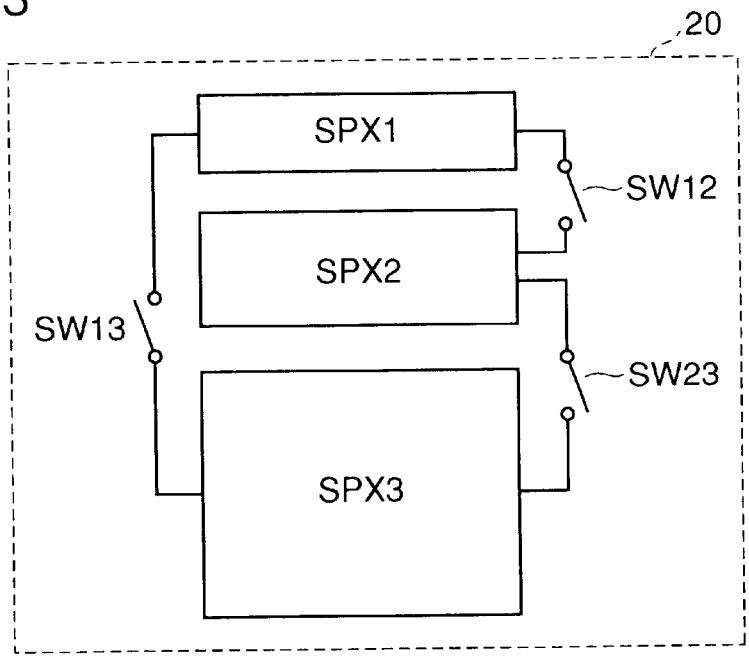
FIG. 3 is a diagram used for explaining the concept of connection between the sub pixels when each pixel is divided into three sub pixels.

FIG. 3 is a diagram used for explaining a concept of connection between the sub pixels when each pixel is divided into three sub pixels.

Referring to FIG. 3, when each pixel is divided into three sub pixels SPX1 to SPX3, a greater number of gradation tones can be implemented by arranging between the sub pixels switches SW12, SW23 and SW13, which can independently be turned on/off.

In this case, similarly, the sub pixels and sub pixel control switches SW12, SW23 and SW13 are arranged in a matrix and controlled in synchronization with the vertical and horizontal scanning lines.

Second Embodiment

Figure 4:
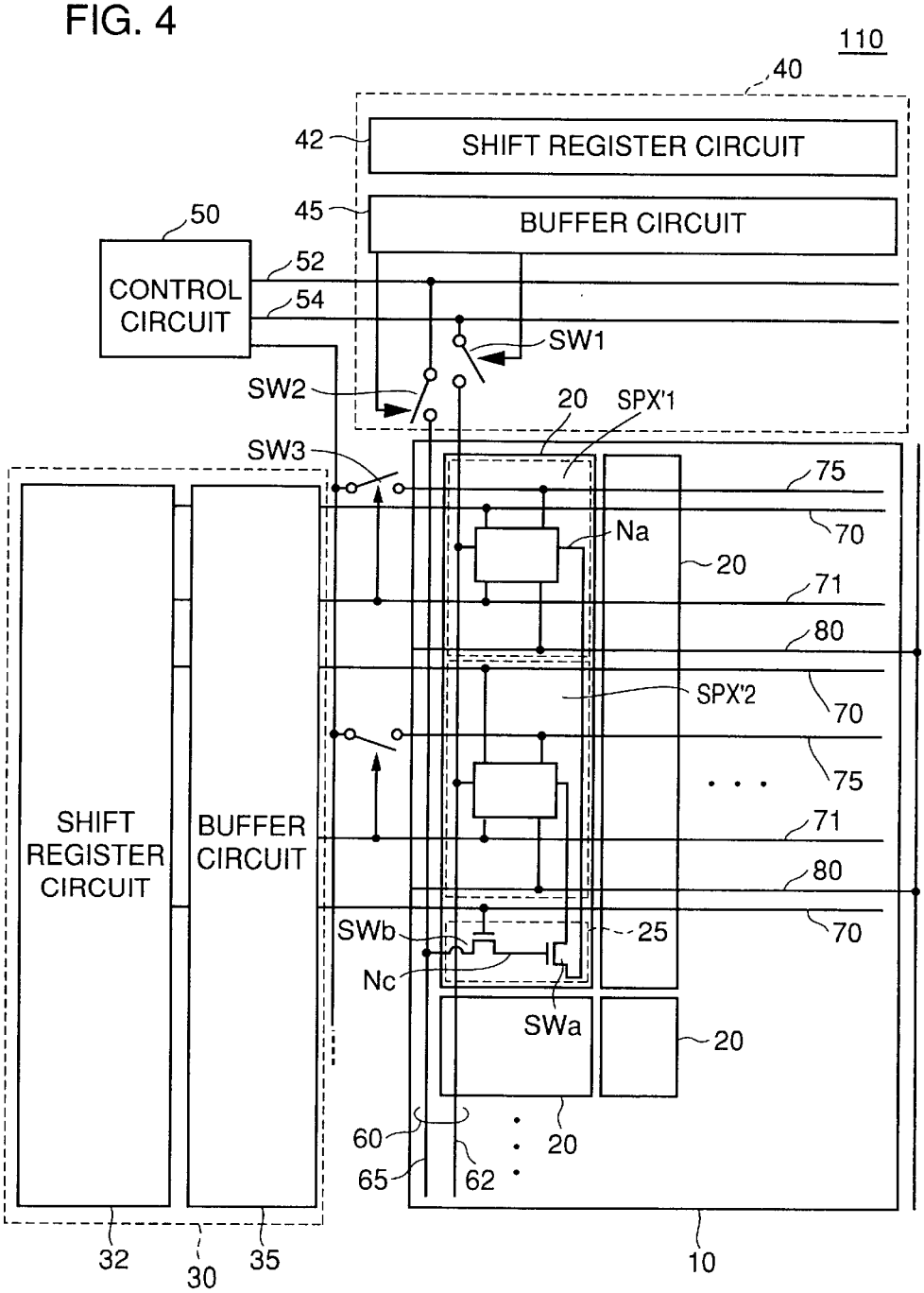
FIG. 4 is a block diagram schematically showing an overall structure of a liquid crystal display device according to the second embodiment of the present invention.

FIG. 4 shows a schematic block diagram showing a structure of a liquid crystal display device 110 according to the second embodiment of the present invention.

Referring to FIG. 4, liquid crystal display device 110 is different from liquid crystal display device 100 according to the first embodiment in the structure of sub pixels. A sub vertical scanning line 71, image signal line 75 and switches SW3 are arranged in addition to vertical scanning line 70, corresponding to each row of sub pixels.

Sub vertical scanning lines 71 are sequentially activated with a prescribed period by vertical scanning circuit 30. Upon activation, a positive voltage is applied to sub vertical scanning line 71 as in the case of vertical scanning line 70.

Switch SW3 is turned on in response to the activation of sub vertical scanning line 71 for transmitting a reference potential generated by a control circuit 50 to an image signal line 75. Note that a structure where the reference potential is always supplied to each image signal line 75 without arranging SW3 may be possible.

The other parts of the structure are the same as those of FIG. 1, and therefore description thereof will not be repeated.

Figure 5:
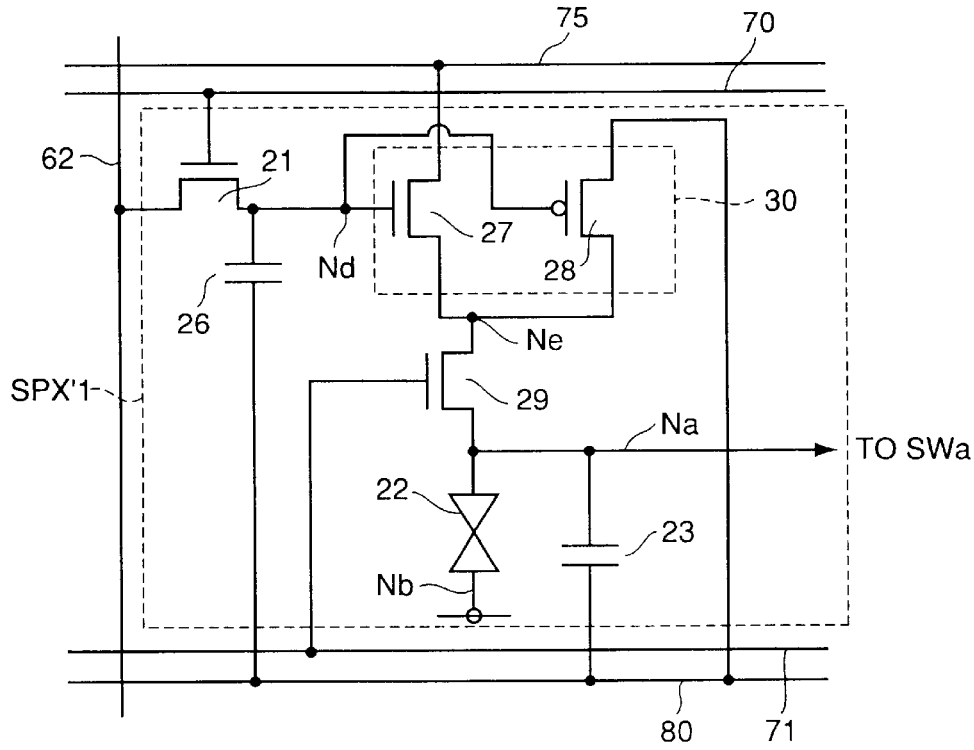
FIG. 5 is a circuit diagram shown in conjunction with a structure of a sub pixel according to the second embodiment.

FIG. 5 shows a circuit diagram used for explaining a structure of a sub pixel according to the second embodiment.

Referring to FIG. 5, a sub pixel SPX'1 according to the second embodiment is different from sub pixel SPX1 of the first embodiment in that it includes a capacitor for control 26, connection switching circuits 31 having TFT elements 27 and 28, and TFT element 29 used as a switch element.

Capacitor for control 26 is connected between internal node Nd, which is connected to first data line 62 through TFT element 21 upon activation of vertical scanning line 70, and a common line 80.

TFT element 27 is an n type, has its gate connected to internal node Nd, and electrically connected between image signal line 75 and internal node Ne. TFT element 28 has a conductivity type different from that of TFT element 27 and is turned on in a complementary manner with respect to TFT element 27 in accordance with the potential level of internal node Nd. TFT element 28 has its gate connected to internal node Nd and is electrically connected to common line 80 and internal node Ne.

TFT elements 27 and 28 are turned on/off in accordance with the potential level of internal node Nd in a complementary manner, so that connection switch circuits 31 connects one of pixel signal line 75 and common line 80 to internal node NE in accordance with the potential level of internal node Nd.

A TFT element 29 has its gate connected to sub vertical scanning line 71 and is electrically connected between internal node Ne and pixel electrode node Na.

Thus, one of pixel signal line 75 and common line 80 is connected to pixel electrode node Na in accordance with the potential level of internal node Nb during activation of sub vertical scanning line 71.

As in the case of the above described sub pixel SPX1, the potential level at pixel electrode node Na is retained by storage capacitor 23.

In sub pixel SPX'1, a display signal indicating the on/off state of the sub pixel is transmitted by first data line 62 and further to internal node Nd in response to the on state of TFT element 21 and held at capacitor control 26. Accordingly, when the next row is scanned and corresponding vertical scanning line 70 is inactivated, the once applied potential level is retained at internal node Nd.

When the potential level held at internal node Nd is at an H level and turning on of sub pixel SPX'1 is designated, the on state of TFT element 27 is maintained. Thus, upon activation of sub vertical scanning line 71, pixel electrode node Na and pixel signal line 75 are connected. Conversely, when 0 or a negative voltage is retained at internal node Nd, and turning off of sub pixel SPX'1 is designated, TFT element 28 is turned on in a complementary manner with respect to TFT element 27. Upon activation of sub vertical scanning line 71, pixel electrode node Na and common line 80 are connected.

As described above, pixel electrode node Na holds an instruction of turning on/off to the sub pixel at capacitor for control 26 for periodically connecting one of pixel signal line 75 and common line 80 to pixel electrode node Na upon activation of sub vertical scanning line 71. As a result, in continuously displaying the same image, a writing operation at a high operation frequency for driving the vertical and horizontal scanning lines is not performed after the instruction of turning on/off each sub pixel corresponding to the same image is once held at capacitor for control 26. Rather, sub vertical scanning line 71 is periodically activated at a low operation frequency to continuously display a desired image.

Consequently, power consumption of the horizontal and vertical circuits can be reduced in continuously displaying the same image.

Moreover, since the connection of pixel signal line 75 and common line 80 to pixel electrode node Na is maintained, the potential level of pixel electrode node Na does not change and reflectance (luminance) does not change.

Here, the reference potential transmitted by pixel signal line 75 is set such that the potential written to the pixel electrode is at a first potential level obtained by adding a liquid crystal driving voltage to a potential level of the opposite substrate (common electrode), or a second potential level obtained by subtracting the liquid crystal driving voltage from the potential level of the opposite substrate (common electrode), so as to maximize the reflectance (the reflectance is minimized in a so called normally white mode) of the liquid crystals in the sub pixel which has been instructed to be turned on. By periodically switching between the first and second potential levels of different polarities for use as the reference potential, a problem is avoided which is associated with image sticking of orientation of the liquid crystals due to constant application of a potential in the same direction.

Further, if the potential level transmitted by common line 80 is set such that the level of a potential written to the pixel electrode equals to that of the opposite substrate (common electrode), the reflectance of the liquid crystals in the sub pixel instructed to be turned off is minimized (maximized in the normally white mode). Thus, the contrast of the sub pixels, respectively instructed to be turned on and off, can be maximized.

Accordingly, in the liquid crystal display device according to the second embodiment, connection of the pixel electrodes of the sub pixels can be implemented and the on/off instruction with respect to the sub pixel can be held in the sub pixel, so that reduction in power consumption is achieved when continuously displaying the same image.

Further, a structure of the sub pixel capable of stably outputting maximum luminance and minimum luminance enables a multiple-gray scale operation with excellent contrast.

Modification of Second Embodiment

Figure 6:
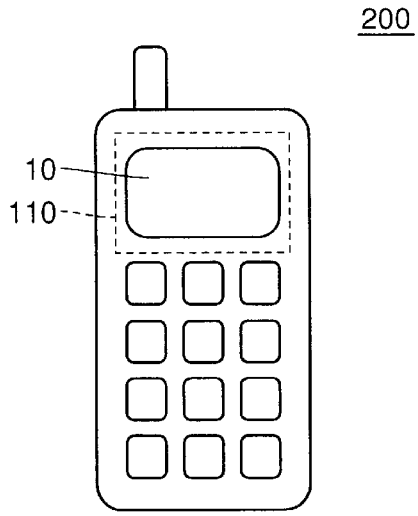
FIG. 6 is an illustration showing a portable telephone according to a modification of the second embodiment.

FIG. 6 is an illustration showing a portable telephone 200 according to the modification of the second embodiment.

Referring to FIG. 6, portable telephone 200 is provided with a liquid crystal display device 110 according to the second embodiment. A display portion of the portable telephone is formed by a liquid crystal display portion 10 of liquid crystal display device 110. Thus, the sub pixel of the display portion has the same structure as that of FIG. 5. Consequently, reduction in power consumption is achieved when continuously displaying the same image.

This characteristic is ideal for the portable telephone required to consume less power in a so called wait mode. Portable telephone 200 with liquid crystal display device 110 of the second embodiment can implement multiple-gray scale based on digital data without impairing a display quality such as resolution and prolong the battery life by consuming less power.

Figure 7:
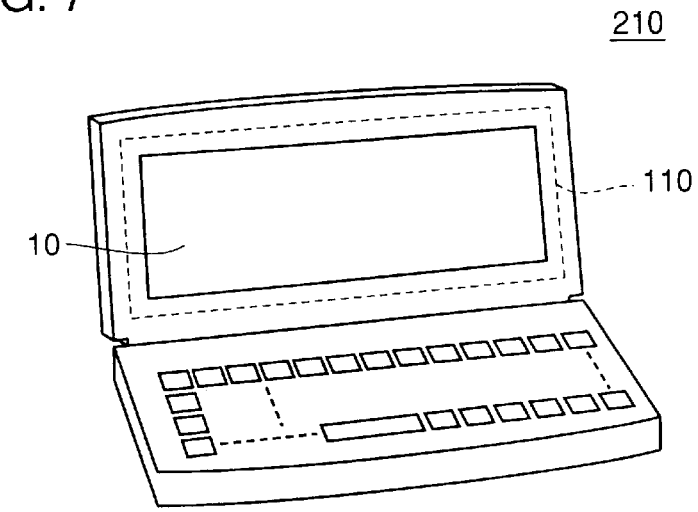
FIG. 7 is an illustration showing a portable digital assistance device according to the modification of the second embodiment.

FIG. 7 is an illustration showing a portable digital assistance device 210 according to the modification of the second embodiment.

Referring to FIG. 7, as in portable telephone 200, portable digital assistance device 210 is also provided with liquid crystal display device 110 of the second embodiment. Accordingly, reduction in power consumption is achieved when continuously displaying the same image.

Therefore, portable digital assistance device 210 can implement multiple-gray scale based on digital data without impairing a display quality such as resolution and prolong the battery life by consuming less power.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A liquid crystal display device, comprising:

a plurality of vertical scanning lines and a plurality of horizontal scanning lines arranged in a matrix; and a plurality of pixels arranged in a matrix, each of said pixels including M (where M is an integer and at least 2) sub pixels, each of said sub pixels including a liquid crystal display element, a common electrode and a pixel electrode arranged on opposite sides of said liquid crystal display element, and a first switch element electrically connected between said pixel electrode and one of said horizontal scanning lines, and being controllably turned on and off in accordance with a potential of one of said vertical scanning lines, each of said pixels further including a sub pixel connection switch for connecting said pixel electrodes of two of said M sub pixels, said sub pixel connection being controllably turned on and off in accordance with a potential of one of said horizontal scanning lines and a potential of the one of said vertical scanning lines which is not connected to all of said first switching elements included in said pixel, wherein each of said first switch elements included within a pixel is connected to a common one of said horizontal scanning lines and turned on and off in accordance with potentials of respective corresponding vertical scanning lines.

2. The liquid crystal display device according to claim 1, wherein each of said plurality of horizontal scanning lines includes a first data line transmitting a potential applied to said pixel electrode; and a second data line transmitting a signal for controlling said sub pixel connection switch, and each of said sub pixel connection switches includes a switch element connecting said second data line and a connection control node in accordance with a potential of said vertical scanning line, said sub pixel connection switch being turned on and off in accordance with a potential at said connection control node.

3. The liquid crystal display device according to claim 2, wherein said first data line transmits one of a potential corresponding to said common electrode and a potential having a potential difference with respect to the potential of said common electrode corresponding to a driving voltage of said liquid crystal display element.

4. The liquid crystal display device according to claim 1, wherein said M sub pixels have display areas of different sizes.

5. The liquid crystal display device according to claim 1, wherein each of said sub pixels further includes a storage capacitor connected in parallel with said liquid crystal display element, and each of said M sub pixels has a different capacitance from said liquid crystal display element and said storage capacitor.

6. The liquid crystal display device according to claim 1, further comprising a sub vertical scanning line, a first reference potential line, and a second reference potential line corresponding to a respective one of said vertical scanning lines, wherein each of said sub pixels includes a second switch element and a connection switching circuit connected in series to said first switch element, between said pixel electrode and the common one of said horizontal scanning lines, a control capacitor for retaining a potential level at the first internal node, wherein said first switch element electrically connects the internal node to the common one of said horizontal scanning lines in accordance with the potential of said one of said vertical line, said connection switching circuit connecting one of said first reference potential line and said second reference potential line to a second internal node in accordance with the potential at the first internal node, and said second switch element connecting the second internal node and said pixel electrode in accordance with a potential of said sub vertical scanning line.

7. The liquid crystal display device according to claim 6, wherein said connection switching circuit includes a first thin film transistor having a channel of a first conductivity type electrically connected between said first reference potential line and the second internal node and having a gate electrode connected to the first internal node, and a second thin film transistor having a channel of a second conductivity type electrically connected to the second reference potential line and said second internal node, and having a gate electrode connected to the first internal node.

8. The liquid crystal display device according to claim 6, wherein said first reference potential line transmits a potential corresponding to said common electrode, and said second reference potential line transmits a potential having a potential difference with respect to the potential of said common electrode corresponding to a driving voltage of said liquid crystal display element.

9. The liquid crystal display device according to claim 6, wherein said horizontal scanning lines transmit digital signals for turning on and off each of said sub pixels.

10. A portable telephone, comprising:

a liquid crystal display portion for displaying information in accordance with a digital signal, said liquid crystal display portion including a plurality of vertical scanning lines and a plurality of horizontal scanning lines arranged in a matrix, and a plurality of sub vertical scanning lines, a plurality of first reference voltage lines, and a plurality of second reference potential lines each arranged in correspondence with each of said plurality of vertical scanning lines, and a plurality of pixels arranged in a matrix, each of said pixels having M(where M is an integer and at least 2) sub pixels, each of said sub pixels corresponding to one of said plurality of vertical scanning lines and corresponding to one of said plurality of horizontal scanning lines, each of said sub pixels including a liquid crystal display element, a common electrode and a pixel electrode arranged on opposite sides of said liquid crystal display element, a first switch element connecting said corresponding horizontal scanning line and a first internal node in accordance with a potential at said corresponding vertical scanning line, a control capacitor for retaining a potential level at the first internal node, a connection switching circuit connecting one of said first and second reference potential lines to a second internal node in accordance with the potential level at the first internal node, and a second switch element connecting the second internal node and said pixel electrode in accordance with a potential at said corresponding sub vertical scanning line, each of said pixels further including a sub pixel connection switch arranged between said pixel electrodes of two of said M sub pixels, and said sub pixel connection switch corresponding to one of said plurality of vertical scanning lines and corresponding to one of said plurality of horizontal scanning lines and being controllably turned on and off in accordance with the potentials of said corresponding vertical and horizontal scanning lines.

11. The portable telephone according to claim 10, wherein said horizontal scanning lines transmit the digital signals for turning on and off said sub pixels.

12. A portable digital assistance device; comprising:

a liquid crystal display portion for displaying information in accordance with a digital signal, said liquid crystal display portion including a plurality of vertical scanning lines and a plurality of horizontal scanning lines arranged in a matrix, and a plurality of sub vertical scanning lines, a plurality of first reference voltage lines, and a plurality of second reference potential lines each arranged in correspondence with each of said plurality of vertical scanning lines, and a plurality of pixels arranged in a matrix, each of said pixels having M (where M is an integer and at least 2) sub pixels, each of said sub pixels corresponding to one of said plurality of vertical scanning lines and corresponding to one of said plurality of horizontal scanning lines, each of said sub pixels including a liquid crystal display element, a common electrode and a pixel electrode arranged on opposite sides of said liquid crystal display element, a first switch element connecting said corresponding horizontal scanning line and a first internal node in accordance with a potential at said corresponding vertical scanning line, a control capacitor for retaining a potential level at the first internal node, a connection switching circuit connecting one of said first and second reference potential lines to a second internal node in accordance with the potential level at the first internal node, and a second switch element connecting the second internal node and said pixel electrode in accordance with a potential at said corresponding sub vertical scanning line, each of said pixels further including a sub pixel connection switch arranged between said pixel electrodes of two of said M sub pixels, and said sub pixel connection switch corresponding to one of said plurality of vertical scanning lines and one of said plurality of horizontal scanning lines and being controllably turned on and off in accordance with the potentials of said corresponding vertical and horizontal scanning lines.

13. The portable digital assistance device according to claim 12, wherein said horizontal scanning lines transmit the digital signals for turning on and off said sub pixels.

* * * * *